US010226068B2

(12) United States Patent
Rasouli et al.

(10) Patent No.: US 10,226,068 B2
(45) Date of Patent: Mar. 12, 2019

(54) MULTI-SEGMENT SMOKING ARTICLE

(71) Applicant: PHILIP MORRIS PRODUCTS S.A., Neuchatel (CH)

(72) Inventors: Firooz Rasouli, Pully (CH); Celine Gambs, Zurich (CH); Carlos Andres Sanchez, Makati (PH); Antonio Tuzzolino, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 1224 days.

(21) Appl. No.: 14/349,183

(22) PCT Filed: Oct. 8, 2012

(86) PCT No.: PCT/EP2012/004210
§ 371 (c)(1),
(2) Date: Apr. 2, 2014

(87) PCT Pub. No.: WO2013/050179
PCT Pub. Date: Apr. 11, 2013

(65) Prior Publication Data

US 2014/0283853 A1 Sep. 25, 2014

(30) Foreign Application Priority Data

Oct. 7, 2011 (EP) ..... 11008141

(51) Int. Cl.
*A24D 1/00* (2006.01)

(52) U.S. Cl.
CPC ..... *A24D 1/00* (2013.01)

(58) Field of Classification Search
CPC ..... A21D 1/04; A21D 1/00
(Continued)

(56) References Cited

U.S. PATENT DOCUMENTS 4,516,590 A * 5/1985 Teng ..... A24B 13/00 131/352
4,730,628 A * 3/1988 Townsend ..... A24D 1/00 131/360

(Continued)

FOREIGN PATENT DOCUMENTS

DE 40 22 362 1/1992
EP 0 244 272 11/1987

(Continued)

OTHER PUBLICATIONS

Office Action issued in Taiwan for Application No. 101137087 dated Jan. 26, 2016 (4 pages). English translation included.

(Continued)

*Primary Examiner* — Michael H. Wilson
*Assistant Examiner* — Yana B Krinker
(74) *Attorney, Agent, or Firm* — Mueting, Raasch & Gebhardt, P.A.

(57) ABSTRACT

A smoking article (1) comprising a rod (2) of smokable material with a mouth end (3) and a distal end (4) remote from the mouth end (3). The rod (2) comprises at least a first and a second segment (5, 6), wherein the first segment (5) has a distal end defining the distal end of the rod (2) and the second segment (6) is disposed downstream of the first segment. The smoking article further comprises a mouthpiece (7), which is attached to the mouth end (3) of the rod (2), wherein the first segment (5) comprises a first tobacco blend with a first level of a smoke constituent and the second segment (6) comprises a second tobacco blend with a second level of the smoke constituent, wherein the second level of the smoke constituent is lower than the first level.

8 Claims, 1 Drawing Sheet

Figures 1, 2:
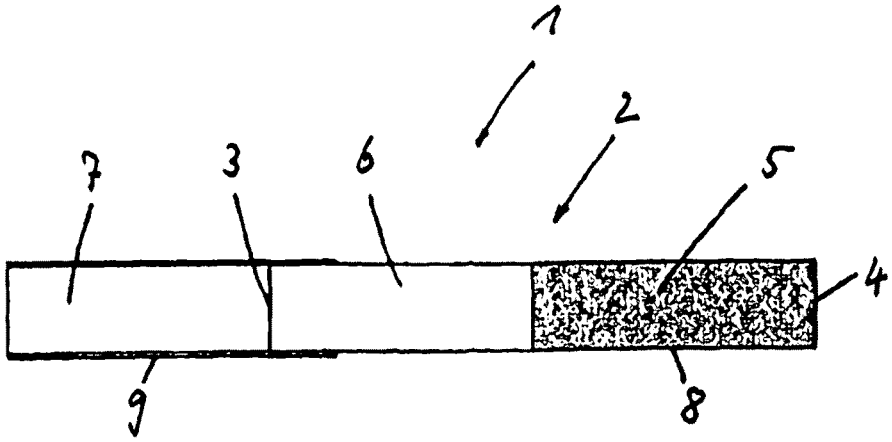

(58) Field of Classification Search
USPC ..... 131/360, 352
See application file for complete search history.

(56) References Cited

U.S. PATENT DOCUMENTS

| | | | | |
|---|---|---|---|---|
| 4,759,380 | A * | 7/1988 | Norman | A24D 1/04 131/360 |
| 2001/0000235 | A1 | 4/2001 | Bowen | |
| 2002/0000235 | A1 | 1/2002 | Shafer | |
| 2006/0254607 | A1* | 11/2006 | Borgognon | A24D 1/00 131/361 |
| 2008/0245377 | A1* | 10/2008 | Marshall | A24B 15/10 131/332 |

FOREIGN PATENT DOCUMENTS

| | | |
|---|---|---|
| GB | 2 355 643 | 5/2001 |
| JP | H03-180166 | 8/1991 |
| JP | H05-252928 | 10/1993 |
| JP | H06-209756 | 8/1994 |
| JP | 2008-509703 | 4/2008 |
| JP | 2010-510780 | 4/2010 |
| WO | WO 2004/107885 | 12/2004 |
| WO | WO 2005/099493 | 10/2005 |
| WO | WO 2008/064463 | 6/2008 |
| WO | WO 2009/045860 | 4/2009 |

OTHER PUBLICATIONS

Office Action issued in Japan for Application No. 2014-533804, 3 pages. English translation only.
Office Action issued in China for Application No. 201280049134.1, 15 pages. English translation included.
PCT International Search Report for International Application No. PCT/EP2012/004210 dated Feb. 18, 2013 (4 pages).
Search Report for Europe for Application No. 11008141.1-2313 dated Feb. 29, 2012 (5 pages).
Office Action issued in Kazakhstan for Application No. 2014/1582.1 dated Aug. 11, 2015, 7 pages. English translation included.

* cited by examiner

Table 1

| Prototype Number | First segment (tip end) | Second segment (filter end) | Puff count | Tar | Nicotine | CO | TSNA | | | | | Formaldehyde |
|---|---|---|---|---|---|---|---|---|---|---|---|---|
| | | | | | | | NAB | NAT | NNK | NNN | Total TSNA | |
| | | | #/cig | mg/cig | mg/cig | mg/ mg Nicotine | ng/ mg Nicotine | ng/ mg Nicotine | ng/ mg Nicotine | ng/ mg Nicotine | ng/ mg Nicotine | micro g/ mg Nicotine |
| 1 | American | American | 9,56 | 22,2 | 1,67 | 17,8 | 16,9 | 76,1 | 50,3 | 84,3 | 225,6 | 56,40 |
| 2 | American | Virginia | 9,72 | 20,7 | 1,64 | 17,2 | 11,0 | 63,2 | 34,6 | 46,0 | 146,7 | 65,90 |
| 3 | Virginia | American | 9,60 | 21,0 | 1,68 | 16,6 | 16,0 | 67,4 | 33,6 | 60,0 | 156,9 | 82,00 |
| 4 | Virginia | Virginia | 9,47 | 21,3 | 1,66 | 17,6 | 6,0 | 27,8 | 21,1 | 14,3 | 71,2 | 89,50 |

MULTI-SEGMENT SMOKING ARTICLE

This application is a U.S. National Stage Application of International Application No. PCT/EP2012/004210, filed Oct. 8, 2012, which was published in English Apr. 11, 2013, International Patent Publication WO 2013/050179 A1. International Application No. PCT/EP2012/004210 claims priority to European Application No. 11008141.1 filed Oct. 7, 2011.

The present invention relates to a smoking article with at least two segments of smokable material and further to a method for producing such a multi-segmented smoking article.

Filter cigarettes typically comprise a filter aligned in an end-to-end relationship with a wrapped tobacco rod, with the filter attached to the tobacco rod by tipping paper. The tobacco rod usually comprises a single segment of tobacco which includes a blend of tobaccos. However, it is also known to combine several segments of tobacco together to form the tobacco rod. For example, a tobacco rod has been disclosed that is made from two segments of tobacco where one segment has higher quality tobacco blend than the other segment as a cost saving measure. In addition, it has been disclosed to produce a tobacco rod with segments having different densities or diameters in order to provide a uniform nicotine delivery as the tobacco rod is smoked.

It is the object of the present invention to provide a smoking article, and a method for producing a smoking article, wherein one or more smoke constituents are reduced while maintaining desired sensorial attributes and blend characteristics as the smoking article is smoked by the consumer.

According to the present invention there is provided a smoking article comprising a rod of smokable material with a mouth end and a distal end remote from the mouth end, the rod comprising at least a first segment and a second segment, wherein the first segment has a distal end defining the distal end of the rod and the second segment is disposed downstream of the first segment. The smoking article also comprises a mouthpiece, which is attached to the mouth end of the rod. The first segment comprises a first tobacco blend with a first level of one or more endogenous smoke constituents and the second segment comprises a second tobacco blend with a second level of one or more endogenous smoke constituents, wherein the second level is lower than the first level.

"Endogenous smoke constituents" are defined in this application as constituents of the smoke produced from the burning of tobacco that are present in the tobacco before it is burned. "Downstream" and "upstream" are defined in relation to the direction of smoke traveling through the smoking article. In other words, a downstream segment would be relatively closer to the mouth of the consumer than an upstream segment.

In a preferred embodiment, the one or more endogenous smoke constituents includes TSNA (Tobacco Specific Nitrosamine). Most of the TSNAs are found in tobacco products and are produced during plant growth and curing of the tobacco, although it is thought that some is also produced during the process of burning tobacco. In other words, TSNA is an endogenous smoke constituent. Depending on its composition each type of tobacco blend yields different levels of TSNAs. For example Virginia blend tobacco typically yields a lower amount of TSNAs than American blend tobacco because of the lower presence of burley tobacco in Virginia blend, as further discussed below. Higher levels of fertilizer are often used in burley tobacco cultivation and the burley curing process is relatively lengthy, and both factors are thought to influence the amount of TSNA in tobacco. There are a number of different chemical species of TSNAs, but unless indicated otherwise the term "TSNA" in this application will mean the combination of N-nitrosonornicotine (NNN), Nicotine-derived nitrosamine ketone (NNK), N-nitrosoanatabine (NAT), and N-nitrosoanabasine (NAB).

In some embodiments, providing multiple tobacco segments with different tobacco blends allows certain tobacco blends that are preferred for their taste to be used in the first segment of the tobacco rod. The second segment of the tobacco rod may then have a second blend that contains a lower amount of an endogenous smoke constituent. In this way, the overall delivery of the endogenous smoke constituent may be lowered for the cigarette. In addition, condensate from the first segment is deposited in the second segment by the "carry-over effect", limiting the influence of the second segment on the taste of the cigarette. In particular, the carry-over effect occurs when smoke from the first segment is drawn through the second segment and some condensate is deposited in the second segment, carrying over specific flavor characteristics from the material in the first segment. Therefore, the flavor of the first segment can at least partly be experienced by the smoker when the second segment is consumed. Depending on the first tobacco blend and second tobacco blend that are used and depending on the length of the first segment relative to the second segment, the carry-over effect can provide a consistent smoking experience to the smoker. In this way, the overall smoke constituent delivery may be lowered while the taste of the smoke can remain substantially constant over the length of the tobacco rod.

It is also known that the majority of formaldehyde that is produced during smoking is delivered during the first few initial puffs of a cigarette. Formaldehyde is a byproduct that is produced during the combustion of tobacco, and some types of tobacco tend to produce more formaldehyde than others. For example, American blend tobacco comprises air cured burley tobacco, which produces lower amounts of formaldehyde than Virginia flue cured tobacco. It is believed that this lower level of formaldehyde production is due at least in part to the increased amount of a compound that inhibits the production of formaldehyde. For example, it is thought that ammonia or an amino-containing compounds such as an amino acid, tend to inhibit production of formaldehyde, and can therefore be referred to as smoke constituent inhibitors. As one example, the burley tobacco in American blend naturally contains a relatively larger amount of ammonia compared to Virginia blends, and the presence of ammonia is thought to inhibit the production of formaldehyde.

In some embodiments, the amount of ammonia in the first segment is preferably at least 0.08% by weight, more preferably at least 0.12% by weight, most preferably at least about 0.20% by weight. The ammonia present in the first segment is preferably less than 0.75% by weight. In some embodiments, the ammonia present in the first segment is preferably between 0.08% by weight and 0.75% by weight, more preferably between 0.12% and 0.75%, most preferably between 0.20% and 0.75%. The amount of ammonia present in the second segment is preferably less than 0.08% by weight, more preferably less than 0.06% by weight. In some embodiments, the ammonia present in the second segment is preferably between 0.01% by weight and 0.08% by weight, more preferably between 0.01% and 0.06%. The ammonia in the second segment is preferably greater than 0.01% by weight. In some embodiments, the ammonia present in the first segment is preferably at least about twice the amount in the second segment, more preferably at least about three times the amount in the second segment.

Various different types of tobacco blends are known in the art, for example American blend tobacco and Virginia blend tobacco. Different tobacco blends typically contain different types of tobacco or different amounts of certain types of tobacco, or both. Preferably the first segment and the second segment comprise different types of tobacco blends. However, it is also possible to provide a first and a second blend wherein each of them is made of the same type of blend, but each blend has a different composition.

Preferably, the first segment comprises an American blend tobacco. The American blend tobacco preferably comprises flue cured and burley tobacco. The amount of burley content in the American blend tobacco is preferably at least about 30%, more preferably at least about 40%, and most preferably at least about 50% by weight of the lamina portion of the blend. In addition, or in the alternative, the amount of burley content is preferably less than about 70%, more preferably less than about 60% by weight of the lamina portion of the blend. Preferably, the burley content in the American blend is between about 30% and about 70% by weight of the lamina portion of the blend, more preferably between about 40% and about 60%. (By the "lamina portion of the blend" it is meant the portion of the blend excluding lamina that has been processed to change its structure or form, such as expanded tobacco or reconstituted tobacco, or the portions of the blend that do not originate from tobacco lamina, such as stems.) In addition to the lamina portion, the American blend may also comprise one or more of expanded tobacco, reconstituted tobacco, and stem material. American blend tobacco typically comprises a higher amount of TSNA and can yield a lower amount of formaldehyde relative to other types of tobacco blends such as Virginia blend tobacco material.

In addition to American blend, the first segment may also include a blend in which the lamina portion of the blend is all, or substantially all, burley tobacco. For example, the first segment may comprise a blend that is greater than about 80% by weight burley, preferably greater than about 90%, or about 100% burley, based on the lamina portion of the blend. The first segment may also include oriental tobacco, which typically has a naturally high content of ammonia or amino-containing compounds such as amino acids. The amount of oriental tobacco in the blend of the first segment is preferably at least about 30%, more preferably at least about 40%, and most preferably at least about 50% by weight of the lamina portion of the blend. The amount of oriental tobacco in the blend may be as much as about 100% of the lamina portion of the blend, but preferably the amount of oriental content is less than about 80%, more preferably less than about 60% by weight of the lamina portion of the blend. Preferably, the oriental content in the American blend is between about 30% and about 100% by weight of the lamina portion of the blend, more preferably between about 40% and about 80%, most preferably between about 40% and about 60%. In addition to the lamina portion, these tobacco blends may also comprise one or more of expanded tobacco, reconstituted tobacco, and stem material.

Preferably, the second segment of the smoking article comprises a Virginia blend tobacco or an American blend of tobacco, as described above. The Virginia blend tobacco preferably comprises flue cured tobacco. In particular the Virginia blend may comprise at least about 90% flue cured tobacco in the lamina portion of the blend, and more preferably at least about 95%, most preferably about 100%. In addition to the lamina portion, the Virginia blend may also comprise one or more of expanded tobacco, reconstituted tobacco and stem material. Virginia blend tobacco typically comprises a lower amount of TSNA and can yield a higher amount of formaldehyde relatively compared to American blend tobacco.

In some preferred embodiments, the first segment comprises a blend of tobacco that has between about 1500 nanograms and about 4000 nanograms of TSNA per gram of the tobacco blend, more preferably between about 2000 nanograms and about 4000 nanograms, and most preferably between about 2500 nanograms and about 4000 nanograms. In addition, or in the alternative, the second segment preferably comprises a blend of tobacco that has less than about 1500 nanograms of TSNA per gram of the tobacco blend, more preferably less than about 1200 nanograms, and most preferably less than about 1000 nanograms. The amount of TSNA present in the blend of the second segment is preferably at least about 25% lower than the amount of TSNA in the blend of the first segment, more preferably at least about 40% lower, and most preferably at least about 60% lower.

As mentioned above, the length of each tobacco segment may be varied in order to balance the amount of taste delivered by the first segment relative to the taste delivered by the second segment and at the same time reduce the amount of the one or more endogenous smoke constituents that are delivered. In a preferred embodiment, the first segment comprises a length which is greater than 25% of the length of the tobacco rod. More preferably, the length of the first segment is greater than 40%, or most preferably greater than 60% of the length of the tobacco rod. In some embodiments, the length of the first segment may be between about 25% and about 75%, from about 25% to about 60%, or from about 40 to about 60%, of the length of the tobacco rod. In view of the previously described carry-over effect, the specific sensorial characteristics from the first blend are deposited in the second blend during smoking, so that the characteristics of the first blend may be at least partially experienced when the second blend is smoked.

Consequently, according to the present invention, by increasing the length of one segment compared to the other segment, it is possible to achieve a dominant flavor typical for the relatively larger segment.

In another preferred embodiment of the invention the mouthpiece of the smoking article comprises at least one filter element. The filter element can be attached to a mouth end of the second segment of the rod. Preferably, the filter section is a multi-component filter and may contain one or more components having different filtering properties and characteristics.

In some embodiments, the first and second segment abut one another so that there is no space between the first segment and the second segment.

In addition, the tobacco rod may further comprise a third tobacco segment. The first segment and second segment may comprise any of the tobacco blends described above, and the third segment may comprise a third tobacco blend. In a preferred embodiment, the first tobacco blend is an American blend, the second tobacco blend is a Virginia blend and the third tobacco blend is an American blend that is different than the blend of the first segment. The third tobacco segment is preferably disposed between the first tobacco segment and second tobacco segment, downstream of the first tobacco segment and upstream of the second tobacco segment. The addition of a third segment may allow for a more gradual transition between the tobaccos of the first, second and third segments. The first segment may comprise a first tobacco blend with a preferred taste. The second tobacco blend may comprise a tobacco blend that is less preferred from a taste standpoint, but has a lower level of one or more endogenous smoke constituents. The third blend may have some taste characteristics of the first blend in order to provide a more consistent taste throughout the smoking of the tobacco rod. In some embodiments, the third blend may also have a level of the one or more endogenous smoke constituents that is between the level of the one or more endogenous smoke constituents of the first blend and second blend. In preferred embodiments, the one or more endogenous smoke constituents includes TSNA. In addition, the tobacco rod may also have more than one tobacco segment between the first segment and second segment in order to further smooth the transition in taste between the first segment and second segment.

The present invention also relates to a method for producing a multi-segmented smoking article with a rod of smokable material as described above. The method according to the invention comprises supplying a first blend and a second blend of smoking material, wherein the first blend comprises a first level of one or more endogenous smoke constituents, and the second blend comprises a second level of the one or more endogenous smoke constituents. The blends are wrapped in a cigarette wrapper material for forming a tobacco rod. Preferably, the tobacco rod may be formed by alternately placing discrete segments of the first blend and second blend directly in the wrapper material such as a cigarette paper, for example any of the cigarette papers discussed below. In this embodiment, the tobacco rod may be formed using a single wrapper rather than a multiple-wrapper method described below. The tobacco rod may then be combined with a mouthpiece as described below.

Alternatively, the blends are wrapped in a first and a second inner wrapper material, respectively, to form first and second tobacco rod segments, respectively. The first segment and second segment are then placed adjacent one another and the cigarette wrapper is wrapped around the segments to attach them to one another, forming the rod of smokable material. In preferred embodiments, the one or more endogenous smoke constituents includes TSNA.

Preferably, the first and second inner wrapper materials comprise paper, and one or both of the wrappers may comprise tobacco material. Preferably, the first and second inner wrapper materials are highly porous, for example having greater than about 5000 Coresta Units, more preferably greater than about 15000 Coresta Units, and most preferably greater than about 25000 Coresta Units. The cigarette wrapper preferably comprises paper. Preferably, the cigarette paper has a porosity between about 20 Coresta Units and about 300 Coresta Units, more preferably between about 30 Coresta Units and about 200 Coresta Units, most preferably between about 30 Coresta Units and about 100 Coresta Units. If the combined porosity of the inner wrappers and the cigarette wrapper are too low (for example, below about 15 Coresta Units), the cigarette may not provide consistent combustion and the cigarette may go out because of a lack of air flow.

Preferably the cigarette wrapper is wrapped completely along the total length formed by the abutting segments, so that the highly porous wrapping material of each segment is completely covered by the cigarette wrapper.

Preferably, the method further comprises the addition of a mouthpiece to the smoking article. The mouthpiece may be disposed adjacent the second segment and a tipping material may be wrapped around at least a portion of the mouthpiece and at least a portion of the second segment, combining the mouthpiece and the second segment.

Preferably, the first segment and second segment are initially produced as continuous rods of smokable material containing first blend and second blend, respectively. The continuous rods of smokable material are then cut into the appropriate relative lengths (for example, the relative lengths discussed above), and combined as described above.

Preferably, the overall length of smoking articles according to the present invention with all filter segments intact is between about 70 mm and about 128 mm, more preferably about 84 mm.

Preferably, the external diameter of smoking articles according to the present invention is between about 5 mm and 8.5 mm, more preferably about 7.9 mm.

The invention can be described further with reference to the following drawing.

FIG. 1: A smoking article according to an embodiment of the invention.

Test results achieved by the inventive smoking article are also provided by the following table, as shown in FIG. 2, which are further discussed below:

Table 1: Test results regarding tobacco specific nitrosamines constituents (TSNA) and formaldehyde formation produced by an inventive smoking article compared to various other configurations of smoking articles.

FIG. 1 illustrates a smoking article 1 according to the invention. The smoking article 1 comprises a rod 2 of smokable material with a mouth end 3 and a distal end 4 remote from the mouth end 3. The rod 2 is divided into a first segment 5 and a second segment 6 in abutting end to end relation. The first segment 5 defines the distal end 4 of the rod 2 and the second segment 6 is downstream of the first segment 5 and defines the mouth end 3 of the rod 2.

Further, FIG. 1 shows a mouthpiece 7, which is in end to end relation with the second segment 6. A tipping material 9 is wrapped around the mouthpiece 7 and a portion of the second segment 6, in order to connect the mouthpiece 7 to the rod 2. The first segment 5 and the second segment 6 are connected by a cigarette wrapper 8. Although it is not illustrated by FIG. 1, according to another embodiment, the first and the second segments 5, 6 might also be wrapped by a high porosity wrapping material, which lies under the cigarette wrapper 8. The porosity of the cigarette wrapper 8 is lower than the porosity of the high porous material allocated under the cigarette wrapper 8.

The first segment 5 is filled with a first blend of smokable material and the second segment 6 is filled with a second blend of smokable material. The first blend is an American blend and comprises a first level of TSNA and the second blend is a Virginia blend and comprises a second level of TSNA. The second level of TSNA is lower than the first level of TSNA constituents.

Further, as discussed above, an American blend will typically produce less formaldehyde when it is burned in the first few puffs than the amount of formaldehyde that would be produced by a Virginia blend if it were placed at the distal end of the cigarette. As such, the configuration shown in FIG. 1 produces a reduced amount of formaldehyde relative to other cigarettes.

As shown by FIG. 1, the rod 2 can be divided into the first and the second segment 5, 6 with equal length, for example each comprising a length of 28.5 mm. Alternatively, depending on the flavor to be delivered to the smoker, the length of the first or the second segment can be shortened or lengthened.

The first blend in the first segment 5 in FIG. 1 comprises an American blend tobacco. The American blend tobacco comprises flue cured and burley tobacco material, along with certain amounts of reconstituted tobacco, expanded tobacco and stem material (which are collectively referred to as "other tobacco material"). The first blend as used for the first segment 5 as illustrated by FIG. 1 comprises about 25% burley tobacco, about 25% flue cured tobacco and about 50% of other tobacco material. This kind of composition of tobacco materials is typical for an American blend tobacco as used in the invention. By contrast, the second blend of the second segment as illustrated by FIG. 1 comprises a Virginia blend that includes about 100% flue cured tobacco material. No "other tobacco material" is included in the Virginia blend.

As examples, four prototype cigarette designs were produced. The four prototypes each comprise a two-segmented smoking article wherein each segment was the same length (each 50% of the total length of the tobacco rod). Prototype 1 included two segments, both of them having identical American blend tobacco in each segment. The American blend comprised the types and amounts of tobaccos referred to in the previous paragraph, and the total amount of TSNA in the American blend was about 2940 ng per gram of tobacco material in the entire blend (including both lamina and other portions of the blend such as other tobacco material). Prototype 2 includes two segments, with the first distal segment being the American blend referred to above and the second downstream segment being the Virginia blend referred to in the previous paragraph. Prototype 3 included the same two segments as prototype 2, but in opposite order. Prototype 4 included two segments, both of them having the identical Virginia blend in each segment. The Virginia blend was the same as that used in prototypes 2 and 3, and the total amount of TSNA in the Virginia blend was about 930 ng per gram of tobacco material in the entire blend.

Table 1 shows the results of the smoke testing for all of the prototypes. The results show that the amount of TSNA may be relatively reduced by including an American blend along only a portion of the tobacco rod. Prototype 1, with both segments including American blend tobacco, has the highest TSNA delivery in the smoke. Prototypes 2 and 3, with one half of the tobacco rod replaced by Virginia blend, had relatively lower amounts of TSNA in the smoke. Prototype 4, with both segments having Virginia blend, had the lowest relative TSNA level in the smoke. Prototype 2 shows that the amount of formaldehyde and TSNA is relatively lower than prototypes 3 and 4, with the TSNA also being relatively lower than prototype 1. In addition, prototype 2, with American blend at the tip (with the relatively high content of burley) shows that the amount of formaldehyde produced is relatively lower than prototype 3, in which the order of the segments was switched. Prototype 2 also produced less formaldehyde than prototype 4, which has Virginia blend throughout the tobacco rod. Testing for the amount of formaldehyde and TSNA in smoke was performed using the Health Canada Intense method.

When testing for the amount of TSNA in tobacco, the following test was used: Using a standard oven volatiles test, a portion of the tobacco sample is tested to determine the moisture content of the tobacco. 0.75 grams of another portion of the tobacco sample was placed in a flask. A standard solution was produced by adding to acetonitrile, 2 μg/mL (final concentration) of a standard for the TSNA species to be measured (for example, the standard for NNN is D4-NNN). 300 μL of this standard solution was added to the flask. 30 mL of ammonium acetate (100 mM solution) was then added to the flask. The solution was stirred for 30 minutes with a rotating stirrer. The solute portion is then passed through a LC-MSMS (Liquid Chromatography Mass Spectrometer/Mass Spectrometer) system in order to quantify the amount of TSNA, and the amount of TSNA is provided on a dry tobacco basis.

When testing for the amount of ammonia in tobacco, the following test was used: The tobacco was ground and run through a 1.0 mm mesh to obtain ground tobacco. Using a standard oven volatiles test, the moisture content was determined of a 7-8 gram sample of the ground tobacco. A second sample of 0.5 grams of the ground tobacco that was not been subjected to the oven volatiles test was placed in a flask. 100 mL of 5% acetic acid solution was added to this 0.5 gram sample and it was shaken for 30 minutes. The extract was then passed through a pleated filter, which produced the sample for analysis. This sample was then run through a Skalar flow analyzer and the result was used to calculate the percent of ammonia based on the dry weight of tobacco.

The invention claimed is:

1. A smoking article comprising:

an American blend taste rod of smokable material with a mouth end and a distal end remote from the mouth end, the rod comprising at least a first and a second segment, wherein the first segment has a distal end defining the distal end of the rod and the second segment is disposed downstream of the first segment, and a mouthpiece, which is attached to the mouth end of the rod, wherein the first segment comprises a first tobacco blend comprising American blend tobacco with a first level of an endogenous smoke constituent and the second segment comprises a second tobacco blend comprising Virginia blend tobacco with a second level of the endogenous smoke constituent, wherein the second level of the endogenous smoke constituent is lower than the first level, the endogenous smoke constituent being tobacco specific nitrosamine (TSNA), wherein the first tobacco blend includes a higher level of a smoke constituent inhibitor comprising ammonia or an amino acid, than the second tobacco blend, wherein at least 30% by weight of lamina material in the first segment is air cured burley tobacco, and wherein at least 90% by weight of lamina material in the second segment is flue cured tobacco.

2. The smoking article according to claim 1 wherein the first segment comprises a length which is greater than 25% of the length of the tobacco rod.

3. The smoking article according to claim 1 wherein the mouthpiece comprises at least one filter element.

4. The smoking article according to claim 1 wherein the rod of smokable material comprises a third segment disposed between the first and second tobacco segments.

5. The smoking article according to claim 4 wherein the third segment comprises a third tobacco blend with a third level of the endogenous smoke constituent, the third level being between the first and second levels.

6. The smoking article according to claim 1 wherein the first segment comprises a length which is greater than 25% of the length of the tobacco rod.

7. The smoking article according to claim 1 wherein the rod of smokable material comprises a third segment disposed between the first and second tobacco segments.

8. The smoking article according to claim 7 wherein the third segment comprises a third tobacco blend with a third level of the endogenous smoke constituent, the third level being between the first and second levels.

* * * * *